United States Patent [19]

Carrigan et al.

[11] 4,125,044

[45] Nov. 14, 1978

[54] ROTARY CUTTING APPARATUS

[75] Inventors: Robert J. Carrigan, Enfield, Conn.; Gregory Georgiades, Springfield, Mass.

[73] Assignee: Westvaco Corporation, New York, N.Y.

[21] Appl. No.: 752,807

[22] Filed: Dec. 20, 1976

Related U.S. Application Data

[63] Continuation of Ser. No. 290,645, Sep. 20, 1972, abandoned.

[51] Int. Cl.[2] ..... B26D 3/14

[52] U.S. Cl. ..... 83/356.3; 83/671; 83/911; 83/917

[58] Field of Search ..... 83/355, 356.1, 356.3, 83/665, 911, 917, 671, 357

[56] References Cited

U.S. PATENT DOCUMENTS

| | | | |
|---|---|---|---|
| 1,404,788 | 1/1922 | Moore | 93/58.4 |
| 1,567,920 | 12/1925 | Cumfer | 83/357 X |
| 1,572,110 | 2/1926 | Duvall | 83/917 X |
| 2,054,832 | 9/1936 | Potdevin | 93/35 R |

FOREIGN PATENT DOCUMENTS

| | | | |
|---|---|---|---|
| 850,757 | 10/1960 | United Kingdom | 83/671 |

*Primary Examiner*—J. M. Meister

*Attorney, Agent, or Firm*—McCormick, Paulding & Huber

[57] ABSTRACT

A rotary cutting apparatus for forming serially connected envelope blanks from a longitudinally advancing web of sheet material is provided with two rotary knives, both of which rotate into cutting relationship with the same stationary knife but at different times. The web of sheet material is advanced over the stationary knife so that at least one side of the web is positioned between the stationary knife and each of the rotary knives to remove a section at the side of the web. With two sets of rotary and stationary knives operating respectively on the two sides of the web, a series of interconnected envelope blanks can be formed by feeding the web through the cutting apparatus at a speed coordinated with the rotations of the knives. By adjusting the angular relationship of the two rotary knives with respect to one another about the axis of rotation, the section of sheet material removed from the advancing web can be varied correspondingly. Such adjustment in conjunction with a change in the feed rate of the web permits envelope blanks, and resulting envelopes, of different sizes to be formed with the same cutting apparatus.

18 Claims, 6 Drawing Figures

ROTARY CUTTING APPARATUS

CROSS REFERENCE TO RELATED APPLICATION

This application is a continuation of application Ser. No. 290,645 filed on Sept. 20, 1972, now abandoned by the Applicants.

BACKGROUND OF THE INVENTION

The present invention relates to a rotary cutting apparatus for cutting an advancing web of sheet material. More particularly, the present invention is related to an adjustable rotary cutting apparatus for cutting serially connected envelope blanks from a web of sheet material advancing longitudinally through the cutting apparatus.

It is a common practice to manufacture envelopes by cutting envelope blanks in serially connected relationship from a web of sheet material, usually a high quality paper. The web is pulled from a spool and advanced or fed longitudinally through a cutting machine which removes corresponding sections from each side of the web. The knives in the cutting apparatus of the machine are so shaped that the material remaining in the web defines a series of interconnected envelope blanks, each blank having a front panel, two side flaps, a rear panel and a closing flap. The serially connected blanks are subsequently severed from one another by a cut-off knife. Each blank is then folded, pasted and gummed in addition to any other special processing required to form a finished envelope.

The cutting apparatus used in the past at each side of the advancing web of sheet material to form the serially connected envelope blanks has generally included a rotary knife cyclically engaging a stationary knife to shear a section conforming generally to one side flap and portions of the closing flap and the rear panel of the envelope. The cutting edges of the knives would, accordingly, have profiles corresponding precisely with the section of sheet material to be removed from one side of the web. If the size of the envelope was changed in such a manner that it necessitated a change in the shape of the envelope blank along a dimension extending parallel to the direction in which the web was fed through the cutting apparatus, it was necessary to change the rotary knife and stationary knife as well as the advancement of the web through the cutting apparatus during each knife rotation.

To cut different sized envelopes, therefore, it was necessary to have pairs of stationary and rotary knives of different sizes. Both sets of knives at each side of the web were replaced in their entirety whenever a different size of envelope was run.

It is an object of the present invention to disclose a new rotary cutting apparatus in which a single set of knives can be adjusted to cut envelopes of many different sizes.

SUMMARY OF THE INVENTION

The present invention resides in a rotary cutting apparatus for forming serially connected envelope blanks from a longitudinally advancing web of sheet material. The cutting apparatus includes one stationary knife over which at least one side of the advancing web of sheet material passes in a cutting operation. The stationary knife has a cutting edge determining the contours of a section of sheet material to be removed from the one side of the web but the shape of the section to be removed and the cutting edge do not have exactly the same profile.

A first rotary knife having a cutting edge corresponding to at least part of the cutting edge on the stationary knife is supported for rotation about an axis bringing the cutting edges of the first rotary knife and the stationary knife into cutting relationship with the web of sheet material at the one side. The first rotary knife in its preferred form has a cutting edge coextensive with the cutting edge on the stationary knife so that a portion of the section to be removed is entirely severed from the web of sheet material by the first rotary knife. To this extent, the cutting apparatus in the preferred form is similar to the prior art cutting apparatus.

A second rotary knife having a cutting edge corresponding to at least part of the cutting edge on the stationary knife is supported for rotation about the rotational axis of the first knife to also bring the cutting edges of the second knife and the stationary knife into cutting relationship with the web of sheet material. The second rotary knife, however, is held in spaced relationship to the first knife about the rotational axis so that the time interval between the engagement of the web by the first rotary knife and the engagement by the second rotary knife permits at least a segment of the web to advance through the cutting apparatus. The second rotary knife, therefore, operates upon a segment of the web material different from that operated upon by the first rotary knife. By adjusting the spaced relationship of the two rotary knives, the segment of the web operated upon by the second knife can be varied along with the size of the section removed. Coordinating the feed rate of the web and the spacing of the two rotary knives to change the size of the section removed permits envelopes of different sizes to be produced by the same cutting apparatus.

DESCRIPTION OF THE PREFERRED EMBODIMENTS

Figure 1:
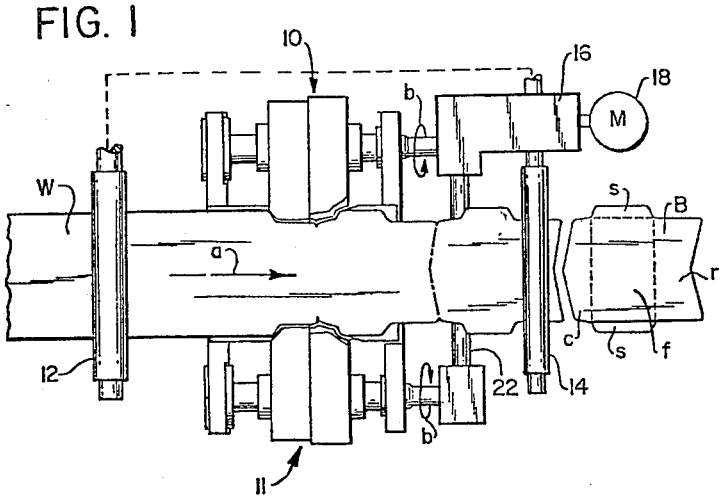
FIG. 1 is a plan view of a machine, incorporating the rotary cutting apparatus of the invention, for forming serially connected envelope blanks.

FIG. 1 shows portions of an envelope forming machine which produce envelope blanks from a web of sheet material that is fed longitudinally, as indicated by the arrow *a*, from a storage roll (not shown) into the machine. The envelope blank B shown at the right-hand side of FIG. 1 has been severed from the web W by a cut-off knife (not shown) and will be recognized as a blank for forming an envelope by the front panel *f* defined by the dotted fold lines, a rear panel or bottom flap *r*, two side flaps *s* and a closing or sealing flap *c*. The completed envelope is subsequently formed by folding the side flaps over the front panel, folding the rear panel over the front panel, pasting the side flaps and rear panel together and gumming the peripheral edge of the closing flap.

In accordance with well-known practice, the envelope blanks B are formed from the web of sheet material by cutting out corresponding sections at each side of the web to form notches as shown in FIG. 1. A series of interconnected blanks is formed. The machine which forms the envelope blanks has at one side of the web W a rotary cutting apparatus, generally designated 10, embodying the present invention. A corresponding apparatus 11, forming a mirror image of the apparatus 10, is located on the other side of the web. A pair of feed rollers 12 (only one visible) engage the top and bottom surfaces of the web at the input to the cutting apparatuses and another pair of rollers 14 (only one visible) engage the web at the output to cause the web W to advance through the cutting apparatus at a selected speed. The rollers 12 and 14 are connected by a variable ratio transmission 16 to a drive motor 18.

The rotary cutting apparatus 10 has a set of knives or blades which operate on one side of the web W to cut out a section and thereby define portions of adjacent blanks B in the web. It will be noted that since the envelope blanks themselves are symmetric about the longitudinal axis of the web, the sections removed by the cutting apparatuses are also symmetric with respect to the same axis. Also, each time a section is removed, part of a side flap and closing flap of one blank and part of the side flap and rear panel of the adjacent blank are formed.

The sets of rotary knives which remove sections from the web W are driven rotatably about axes extending parallel to the longitudinal axis of the web by means of the transmission 16 and motor 18. A cross drive 22 interconnects the sets of knives at each side of the web to insure that the knives are driven in synchronism with one another and that they thereby remove sections from laterally opposed stations along each side of the web. The rotary knives make one complete revolution as the material needed to form a single envelope blank advances through the cutting apparatuses 10 and 11. A synchronized relationship of the knife rotations and web feed is maintained by the variable ratio transmission 16. A transmission with variable ratios is used so that the relationship between the feed rate and the rotational speed can be changed whenever it is desired to change the size of the envelope blank.

Figure 2:
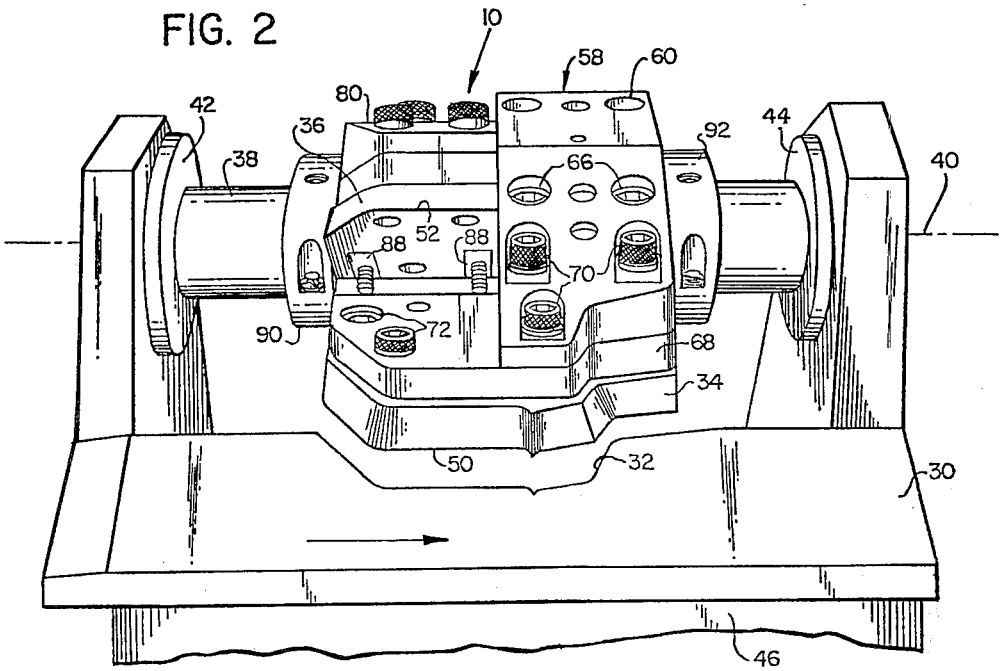
FIG. 2 is a frontal prospective view of the rotary cutting apparatus shown at the one side of the web of sheet material in FIG. 1.
Figure 3:
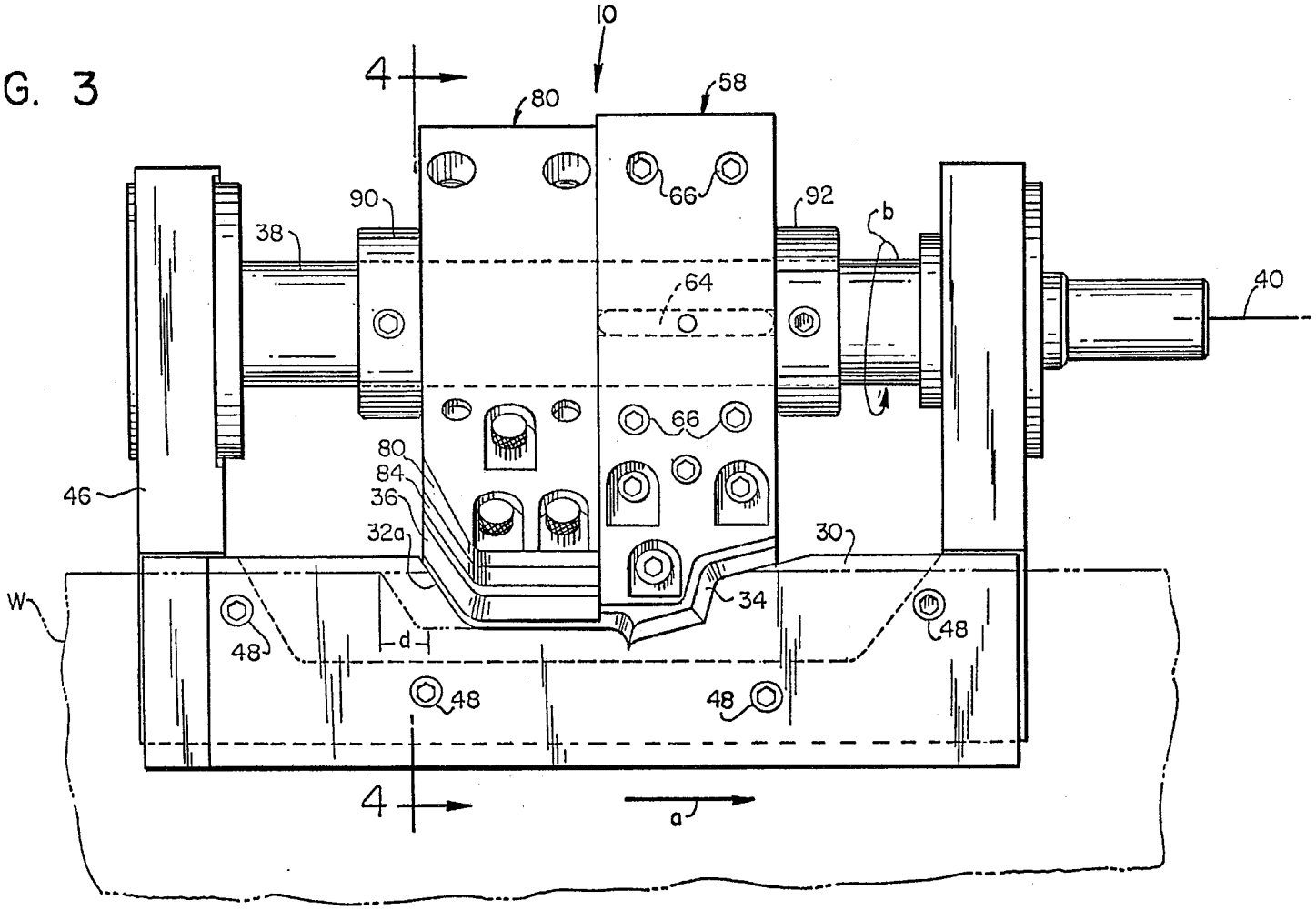
FIG. 3 is a top plan view of the cutting apparatus shown in FIG. 2.
Figure 4:
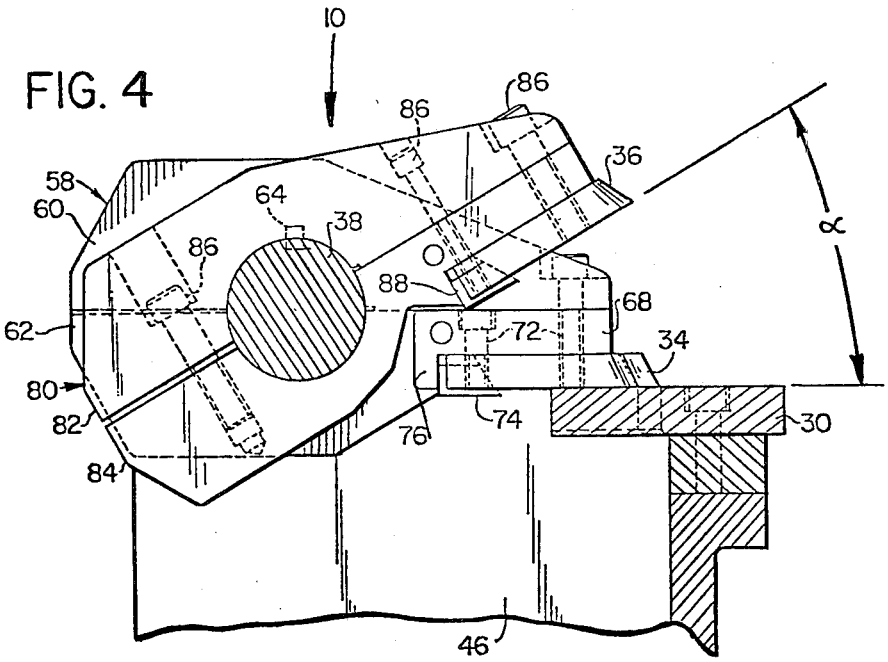
FIG. 4 is a sectional view of the rotary cutting apparatus as viewed along the line 4—4 in FIG. 3.

FIGS. 2–4 show the detailed construction of the rotary cutting apparatus 10 utilized at one side of the web W. The cutting apparatus 10 has a stationary knife or fixed blade 30 over which one side of the web W advances during a cutting operation. The stationary knife 30 has at its midsection a cut-out defined by a shearing or knife edge 32. The edge 32 has curved portions and straight portions which determine the contours of the section to be removed from the one side of the web. It should be understood that the profile of the cutting edge is not exactly the same as the profile of the entire section removed from the web due to the operation of the cutting apparatus which is described in greater detail below.

Figure 5:
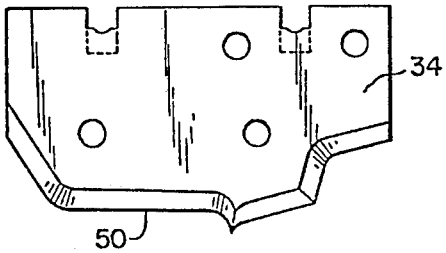
FIG. 5 is a plan view of the larger rotary knife shown in FIGS. 2–4.
Figure 6:
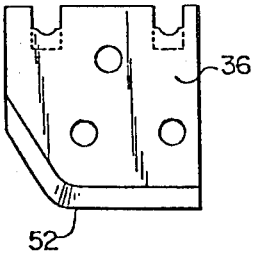
FIG. 6 is a plan view of the smaller rotary knife shown in FIGS. 2–4.

A large rotary knife or leading blade 34, shown separately in FIG. 5, and another small rotary knife or trailing blade 36, shown separately in FIG. 6, are precisely mounted on an arbor shaft 38 and rotate about a rotational axis 40 of the shaft relative to the stationary knife 30. The arbor shaft 38 is supported in journal bearings 42, 44 and two upright sections of a frame 46 to which the stationary knife 30 is fixed by cap screws 48. The rotary knife 34 has a cutting edge 50 corresponding in shape to the cutting edge 32 of the stationary knife 30 and the knife 34 is mounted on the arbor shaft 38 so that the cutting edges 32 and 50 are brought into cutting relationship with the web each time the knife 34 is rotated past the stationary knife 30. In a similar manner, the rotary knife 36 has a cutting edge 52 which corresponds in shape to a part of the cutting edge 32 over which the one side of the web first passes when the web is fed in the direction indicated by the arrows *a* in FIGS. 1, 2 and 3. The knife 36 is also precisely mounted on the shaft 38 so the cutting edges 32 and 52 are brought into cutting relationship with the web of sheet material during each revolution of the shaft 38.

The rotary knife 34 is supported from the shaft 38 by means of a clamp or blade holder 58 including split members 60 and 62, shown most clearly in FIG. 4. The member 60 is held fixedly in position on the arbor shaft 38 by means of a key 64 and cap screws 66. A base plate 68 is mounted in cantilever fashion from the projecting end of the member 60 by means of cap screws 70. The rotary cutting knife 34 is held on the base plate 68 by means of cap screws 70 and 72. Two wedges 74 (only one shown) are engaged respectively by two of the cap screws which hold the knife 34 and are interposed between the knife 34 and a tang 76 at the rear of the base plate 68 to hold the knife 34 precisely in its radially projecting position with respect to the shaft 38.

The small rotary knife 36 is mounted on the arbor shaft 38 by means of an adjustable clamp or blade holder 80 including split members 82 and 84. Unlike the clamp 58, the clamp 80 is not keyed to the shaft 38 but instead is capable of being adjusted to different angular positions about the shaft. Cap screws 86 hold the members 82 and 84 in clamping relationship with the shaft 38. The cap screws at the projecting end of the clamp 80 also secure the knife 36 to the clamp and a pair of wedges 88 precisely position the knife 36 in a radially projecting position when the cap screws 86 are tightened. Of course, the positions in which the rotary knives 34 and 36 are held bring the cutting edges 50, 52 of the knives into shearing or cutting relationship with the edge 32 on the stationary knife 30 as shown for example, by the knives 30 and 34 in FIG. 4.

The bushings 90 and 92 hold the clamps 58 and 80 in an axially fixed position along the arbor shaft 38.

OPERATION

The operation of the cutting apparatus 10 at the one side of the web W is best described in connection with FIGS. 3 and 4. As the web advances through the cutting apparatus in the direction of the arrow *a*, the arbor shaft 38 is rotated as indicated by the arrow *b* (also shown in FIG. 1). When the cutting edges of the rotary knife 34 and stationary knife 30 come together on the web, a portion of the section to be removed to form an envelope blank is cut from the one side of the web. The portion removed by the knife 34 has the same profile as the cutting edges 32, 50 on the knives 30 and 34.

The web W continues to advance after the knife 34 rotates downwardly through the cut-out in the stationary knife 30. When the second or small rotary knife 36 rotates downwardly onto the web W in cutting relationship with the knife 30, a longitudinal segment of the web W represented in FIG. 3 by the dimension *d* will have moved over the stationary knife 30 and the remaining, generally trapezoidal portion of the section to be removed is cut by the knife 36. It will be readily apparent that by adjusting the clamp 80 and varying the angle between the rotating knives 34 and 36, the size of the section removed by the cutting apparatus 10 is changed.

To set up the machine and adjust the cutting apparatus 10 for an envelope blank of a given size, the feed rate of the web W and the rotational speed of the cutting knives 34 and 36 are adjusted relative to one another by means of the variable ratio transmission 16 in FIG. 1. The relationship of the rotational speed and the feed rate is selected so tht the rotary knife 34 makes one complete revolution with the arbor shaft 38 while the web of sheet material advances by an amount equal to the cut-off length of an envelope blank, the longitudinal length of the web between corresponding points on serially adjacent envelope blanks.

The angular relationship between the rotary knife 34 and the rotary knife 36 is then determined from the incremental portion which is to be cut solely by the small knife 36 from the section forming the blank of given size. Such portion has a length equal to the distance the web advances after the knife 34 cuts the web and until the knife 36 cuts the web. The distance is represented in FIG. 3 by the dimension *d*. Establishing a ratio in which the numerator is *d* and the denominator is the cut-off length, and multiplying the ratio by 360° determines the angle $\alpha$ defining the spaced relationship of the two rotary knives. By adjusting the angular relationship of the knives to the determined angle, the desired section will be removed from the web during each revolution of the arbor shaft 38.

It will be understood that normally part of the cutting edge 52 on the knife 36 will partially duplicate or overlap upon the longitudinally extending cut produced by a part of the cutting edge 50 on the knife 34. The amount of the overlap along the longitudinal cut depends upon the angular adjustment of the knives 34 and 36. The angular spacing of the knives 34 and 36 reaches an upper limit at a point where the overlap disappears so that the longitudinally extending parts of the cutting edges 50 and 52 produce longitudinally "contiguous" cuts. "Contiguous" here means in actual contact and non-overlapping.

It will thus be seen that the disclosed rotary cutting apparatus can be adjusted to cut envelope blanks of different sizes with the same set of stationary and rotating knives. It is no longer necessary to maintain many sets of knives for many different blanks. Substantial savings can be realized with the cutting apparatus because the knives have one basic design.

While the present invention has been described in a preferred embodiment, it should be understood that still other modifications and substitutions can be had without departing from the spirit of the invention. Although the rotary knife 34 has a cutting edge 50 corresponding substantially to the entire cutting edge 32 of the stationary knife 30 and the edge 52 on knife 36 is shorter, it is possible to utilize two shorter rotary knives having cutting edges which correspond in shape to overlapping parts of the cutting edge 32 on the stationary knife. For example, if the knife edge 50 on the rotary knife 34 terminated without having a portion mating with the diagonally extending part 32*a*, (FIG. 3) of the edge 32, the rotary cutting apparatus, nevertheless, would operate successfully and remove a section at the side of the web in substantially the same manner as described above. The only difference in operation that could be observed would be that the entire section cut from the web would be removed in one piece rather than in two pieces. It is merely necessary that the cuts produced by the two shorter rotary blades intersect, preferably in overlapping relationship, so that a section is completely severed from the one side of the web. The particular construction of the clamping members, can, of course, be varied in order to permit one or both of the knives to be angularly adjusted about the arbor shaft 38. It is, however, preferable to have the rotary knife which forms a portion of the closing flap keyed to the shaft since the shaft and the cut-off knife are drivingly interconnected, and the cut-off knife and the rotary knife forming the closing flap must operate upon the advancing web at precisely related positions. While the present invention has been disclosed with two rotary knives adjustable relative to one another about the arbor shaft, it is possible that additional adjustable rotary knives must be added to operate in conjunction with the stationary knife 30 upon successive segments of the advancing web. Accordingly, the present invention has been described in a preferred embodiment by way of illustration rather than limitation.

We claim:

1. A rotary cutting apparatus for removing sections from a longitudinally advancing web of sheet material comprising: a stationary cutting knife over which at least one side of the advancing web of sheet material passes in a cutting operation, the stationary knife having contoured cutting edge portions determining the contours of one section of material to be removed from the one side of the web passing over the stationary cutting knife and having one continuous straight edge portion extending parallel to the advancing web; an arbor shaft supported relative to the stationary knife for rotation about a rotational axis parallel to the longitudinally advancing web of material; a first rotary knife having a cutting edge corresponding to at least a part of the cutting edge portions of the stationary knife including a straight edge portion of said continuous straight edge portion of the stationary knife and supported on the arbor shaft in radially projecting relationship for rotation about the rotational axis with the shaft to bring the cutting edges of the first rotary knife and stationary knife into cooperative cutting relationship with the web at the one side and thereby cut at least part of a section from the web including a straight edge parallel to the side of the advancing web; a second rotary knife also mounted on the arbor shaft at an angularly spaced relationship with the first rotary knife and projecting radially from the shaft for rotation with the shaft, the second rotary knife having a cutting edge corresponding to at least a part of the contoured cutting edge portions of the stationary knife to bring the cutting edges of the second rotary knife and the stationary knife into cooperative cutting relationship with the web, the second rotary knife including a straight edge portion spaced from the rotational axis by the same amount as the straight edge portion of the first rotary knife and being positioned on the shaft to also cut the web section along a straight edge portion of said continuous straight edge portion of the stationary knife; means for rotating the first and second rotary knives and the arbor shaft about the rotational axis at a speed selected to cause the cuts produced by the straight edge portions of the rotary knives to overlap in the web along the straight edge as the web moves over the stationary knife; and means for adjusting the angularly spaced relationship of the first and second rotary knives on the shaft about the rotational axis to vary the degree of overlap along the straight edge and the size of the section removed.

2. A rotary cutting apparatus as defined in claim 1 wherein the part of the cutting edge portions of the stationary knife corresponding in shape with the first rotary knife and the part of the cutting edge portions of the stationary knife corresponding in shape with the second rotary knife overlap in the continuous straight edge portion.

3. A rotary cutting apparatus as defined in claim 2 wherein:

one portion of the cutting edge of the stationary knife including the continuous straight edge portion is covered by the advancing web as the web passes over the knife; and the cutting edge of the first rotary knife corresponds in shape to all of said one portion of the cutting edge of the stationary knife over which the web passes whereby the first rotary knife completely severs and frees from the web a portion of the section to be removed from the one side of the web.

4. A rotary cutting apparatus as defined in claim 3 wherein the cutting edge of the second rotary knife corresponds in shape to only part of the one portion of the cutting edge of the stationary knife including a portion of said continuous straight edge portion over which the advancing web of sheet material first passes in a cutting operation whereby the second rotary knife severs another portion of the section to be removed from the one side of the web.

5. A rotary cutting apparatus as defined in claim 1 wherein the spaced relationship of the first and second rotary knives about the rotational axis is an angular spacing no larger than the angular spacing causing the cuts of the first and second knives in the advancing web to be contiguous.

6. A rotary cutting apparatus as defined in claim 2 wherein the spaced relationship of the first and second rotary knives about the rotational axis is an angle defined by a ratio in which the numerator is the longitudinal length of the web cut by the second rotary knife and the denominator is the longitudinal length of the web between corresponding points of serially adjacent blanks cut by the apparatus.

7. A rotary cutting apparatus as defined in claim 1 further including a first clamp secured to the arbor shaft and mounting the first rotary knife to the shaft for rotation with the shaft; and a second clamp adjustably secured to the arbor shaft for angular adjustment about the shaft and mounting the second rotary knife to the shaft for rotation with the shaft and angular adjustment about the shaft relative to the first rotary knife.

8. A rotary cutting apparatus as defined in claim 7 wherein the first and second clamps are secured to the arbor shaft at axially adjacent stations; and a key is interposed between the first clamp and the shaft to hold the first clamp at a given angular position relative to the shaft.

9. A rotary cutting apparatus as defined in claim 2 wherein the entire cutting edge on the second rotary knife corresponds in shape to a part of the cutting edge on the first rotary knife.

10. A rotary cutting apparatus for forming a notch in the lateral side of a strip of sheet material which advances longitudinally of itself and relative to the apparatus along a predefined path in a downstream direction comprising:

a stationary cutting knife positioned at the lateral side of the strip advancing along the predefined path and having a contoured cutting edge including:

a first edge portion extending under the strip parallel to the longitudinal, advancing direction of the strip, a second edge portion connecting with a downstream end of the first edge portion toward and over which the strip advances, the second edge portion extending from the connection with the first edge portion under the strip to a point laterally adjacent the strip at said lateral side, and a third edge portion connecting with the upstream end of the first edge portion over and away from which the strip advances, the third edge portion also extending from the connection with the first edge portion under the strip to a point laterally adjacent the strip at said lateral side;

a rotatable shaft positioned laterally of the strip and extending along an axis of rotation parallel to the longitudinal direction of advancement of the strip;

a first rotary knife having a cutting edge corresponding in shape at least to the contoured cutting edge of the stationary knife between said points laterally adjacent the strip on the second and third edge portions and mounted on the rotatable shaft to bring the cutting edges of the stationary knife and the first rotary knife into cutting relationship with the strip whereby one part of the notch is cut out of the strip;

a secondary rotary knife having a cutting edge corresponding in shape at least to the contoured cutting edge of the stationary knife between a point intermediate the upstream and downstream ends of the first edge portion and a point on the third edge portion laterally adjacent the strip and mounted on the rotatable shaft to bring the corresponding edge portions of the stationary knife and the second rotary knife into cutting relationship with the strip; and means for adjusting the angular relationship of the first and second rotary knives relative to one another on the shaft.

11. A rotatable cutter mechanism for cutting different length notches in the side of a moving web of sheet material comprising, a unitary fixed cutting blade mounted on a support member, said unitary fixed cutter blade having a continuous cutting edge;

a shaft rotatably supported adjacent to said fixed cutter blade, drive means to rotate said shaft;

rotatable cutter means secured to said shaft for rotation therewith, said rotatable cutter means having radially extending blade means, said rotatable cutter means positioned adjacent to said unitary fixed cutter blade so that upon rotation of said rotatable cutter means said radially extending blade means moves in a circular path and periodically moves into cutting relation with said fixed cutter means along said continuous cutting edge to cut a notch in the side of a moving web of sheet material, said radially extending blade means having a rotatably leading portion angularly displaced from a rotatably trailing portion so that upon rotation of said rotatable cutter means said leading portion is the first portion to move into cutting relation with said fixed cutter blade along said continuous cutting edge and cut at least part of a notch in the side of the web including a longitudinally extending edge of the notch and thereafter said rotatably trailing portion also moves into cutting relation with said fixed cutter means along said continuous cutting edge to cut the remaining part of the notch in the side of the web, and means to vary the angular displacement between said radially extending blade means leading portion and trailing portion to thereby vary the length of the notch cut in the moving web by said rotatable cutter means.

12. A rotatable cutter mechanism for cutting different length notches in a moving web as set forth in claim 11 in which, said radially extending blade means leading portion includes a longitudinally extending edge portion and said trailing portion includes a longitudinally extending edge portion, said longitudinally extending edge portions being in longitudinally overlapped relationship with each other.

13. A rotatable cutter mechanism for cutting different length notches in a moving web as set forth in claim 12 in which, said longitudinally extending edge portions are straight edge portions.

14. A rotatable cutter mechanism for cutting different length notches in a moving web as set forth in claim 11 in which, said leading portions having a blade edge portion arranged to cut an envelope blank seal flap side edge and a portion of an adjacent envelope blank bottom flap side edge in the side of a moving web, and said trailing edge portion having a blade edge portion to cut the remaining portion of said adjacent envelope blank bottom flap edge.

15. A rotatable cutter mechanism for cutting different length notches in a moving web as set forth in claim 11 in which, said radially extending blade means including a pair of separate cutter blades positioned in side-by-side relation.

16. A rotatable cutter mechanism for cutting different length notches in a moving web as set forth in claim 15 wherein the means to vary the angular displacement between said radially extending blade means includes, separate cutter blade holders mounted on the rotatable shaft, said separate cutter blade holders mounted on said shaft adjacent to each other, at least one of said blade holders being adjustably mounted on said shaft for preselected rotation relative to the other of said blade holders to thereby adjust the angular displacement between said radially extending blade means.

17. A rotary cutting apparatus for forming a notch in the laterial side of a strip of sheet material which advances longitudinally of itself past the apparatus along a predefined path comprising:

a stationary cutting knife positioned along the predefined path at the lateral side of the advancing strip and having a contoured cutting edge including:

a first straight edge portion situated under the strip when the strip is advancing along its predefined path, the fist edge portion having oppositely disposed first and second ends and extending parallel to the longitudinal direction of the advancing strip, a second edge portion adjoining the first end of the first edge portion over which the strip advances and being contoured to extend from the first end under the strip to a point laterally adjacent the strip at said laterial side, and a third edge portion adjoining the second end of the first edge portion and being contoured to extend from the first edge portion to a different point laterally adjacent the strip at said lateral side;

a rotatable shaft positioned laterally of the strip and extending along an axis of rotation parallel to the longitudinal direction of advancement of the strip;

a first rotary knife having a cutting edge corresponding in shape to the cutting edge of the stationary knife between a point on said first edge portion and another point on the second edge portion, and being mounted on the rotatable shaft to bring the cutting edges of the stationary knife and the first rotary knife into cutting engagement with the strip along the corresponding edge portions of the stationary and first rotary knives, a second rotary knife having a cutting edge corresponding in shape to the cutting edge of the stationary knife between a point on said first straight edge portion and another point on the third edge portion, and being mounted on the rotatable shaft to being the cutting edges of the stationary knife and the second rotary knife into cutting engagement with the strip along the corresponding edge portions of the stationary and second rotary knives; and means for adjusting the angular relationship of the first and second rotary knives relative to one another on the shaft.

18. A rotary cutting apparatus as defined in claim 17 wherein the first rotary knife has a cutting edge corresponding in shape to the entire contoured cutting edge of the stationary knife; and the second rotary knife has a cutting edge corresponding in shape to all of the third edge portion but not more than the first and third edge portions.

* * * * *